US005524948A

United States Patent [19]

Bostwick

[11] Patent Number: 5,524,948

[45] Date of Patent: Jun. 11, 1996

[54] CLOTHES HANGER CARRIER

[76] Inventor: Andrew M. Bostwick, 3307 Little Bear, Kingwood, Tex. 77339

[21] Appl. No.: 485,020

[22] Filed: Jun. 7, 1995

[51] Int. Cl.[6] ..... A45C 13/26; A45F 5/10

[52] U.S. Cl. ..... 294/142; 294/165

[58] Field of Search ..... 294/137, 141–143, 294/158, 159, 162, 163, 165; 223/85, 88; 224/313; 248/339, 340

[56] References Cited

U.S. PATENT DOCUMENTS

| | | | |
|---|---|---|---|
| D. 223,802 | 6/1972 | Belland et al. | 294/142 X |
| 3,226,147 | 12/1965 | Marshall | 294/143 X |
| 3,584,772 | 6/1971 | Robertson | 294/142 |
| 3,705,674 | 12/1972 | Fisher | 294/165 |
| 3,731,809 | 5/1973 | Saenger | 211/118 |
| 3,744,600 | 7/1973 | Belland et al. | 294/142 X |
| 3,799,416 | 3/1974 | Schmaltz | 294/142 |
| 3,804,310 | 4/1974 | Wheeler | 294/142 |
| 3,961,734 | 6/1976 | Threeton | 294/143 |
| 4,238,062 | 12/1980 | Wheeler | 224/45 |
| 4,288,012 | 9/1981 | Doak | 294/143 |
| 4,296,959 | 10/1981 | Helbig | 294/143 |
| 4,299,342 | 11/1981 | Kessler et al. | 294/137 X |
| 4,557,516 | 12/1985 | Usner | 294/143 |
| 4,824,156 | 4/1989 | Greene | 294/142 |
| 4,856,688 | 8/1989 | Ackmann | 224/217 |
| 5,104,083 | 4/1992 | Shannon | 248/339 |
| 5,178,430 | 1/1993 | Schopfer | 294/142 |
| 5,306,063 | 4/1994 | Higgins et al. | 294/143 |
| 5,330,244 | 7/1994 | Rodwell | 294/143 |

*Primary Examiner*—Johnny D. Cherry

*Attorney, Agent, or Firm*—C. Steven McDaniel; Carol G. Mintz; Conley, Rose & Tayon

[57] ABSTRACT

A hand held carrier for transporting garments on clothes hangers is disclosed. The carrier is a single structure comprising a contoured handle, a textured post and a shield that houses a hanger port. Within the hanger port, hooks are compressed or bundled while being supported on a semi-circular support bar that orients the hangers substantially parallel to the user's arm when carried. The shielded hanger port serves to protect the user's hand from contact with the tips of the hanger hooks and deters accidental snagging and disengagement. The carrier includes a thumb hook receiver on the underside of the handle for supporting the device on a conventional automobile interior hook. The carrier also includes a centering notch to stabilize the device during loading and unloading when temporarily placed on a clothes rod.

20 Claims, 3 Drawing Sheets

CLOTHES HANGER CARRIER

BACKGROUND OF THE INVENTION

1. Field of the Invention

This invention relates generally to clothes hanger transporting devices and particularly to hand held carriers for transporting multiple hangers loaded with clothing.

2. Description of the Related Art

Handling of clothing on hangers is often difficult, cumbersome and uncomfortable due to the hanger hooks gouging one's palms or cutting into one's fingers. This is particularly a problem when the hanger is holding a heavy garment or when a number of hangers are being hand carried at once. Also, there is the related problem of temporarily supporting the loaded carrier in an automobile while transporting the loaded carrier, or suspending a group of hangers in a closet, for example, while loading or unloading garments. These problems are encountered by people at the consumer level, as travelers with heavy garment bags, or car travelers with a bundle of hanging clothing, or in transporting clothing to and from the dry cleaners or laundromat, as well as by people engaged in commercial activities, as in transportation and delivery of clothing by dry cleaning establishments, or retail clothing stores' inventory movement.

Various devices are known for manually transporting garments on hangers. Some of these address the difficulty of comfortably carrying a number of hangers at once.

U.S. Pat. No. 4,824,156 (Greene) discloses a wire loop for engaging hanger hooks and aligning the hangers and comfortably carrying by means of a cylindrical hand grip.

U.S. Pat. No. 3,584,772 (Robertson) provides a hand held clothes hanger carrier having a flexible strap for engaging the hanger hooks and a handle adapted for suspending the carrier from an automobile clothes hook.

U.S. Pat. No. 5,306,063 (Higgins, et al.) discloses a carrier molded as a single piece and having slotted areas for engaging the clothes hanger hooks.

U.S. Pat. No. 3,799,416 (Schmaltz) discloses a "C" shaped molded hand held carrier having a handle adapted for being supported by a horizontal shelf.

U.S. Pat. No. 5,330,244 (Redwell) discloses a clothes hanger carrier adapted for hanging by a hook or being hand carried by its disk-like base. The base provides a space for advertising indicia.

Certain of the prior art devices are cumbersome to use because the hanger hook holder and the handling means are separate units. Carrying some of the prior art devices is inconvenient because the clothes hangers are not positioned parallel to the user's body. Other prior art devices are not adapted for temporarily suspending the loaded carrier on an auto hook or on a clothes rod, or are not comfortably and easily transferred to and from the interior car hook. Lack of shielding of the hanger hooks by some prior art carriers limits their desirability because the user's hands are unprotected. Some of the known carriers also have the problem of becoming entangled with the hangers while they are being loaded or unloaded. Some of the prior art devices are not sturdy or durable enough for repeated use. There is a need for a compact one-piece carrier that is comfortable to carry, easy to use and durable. A carrier that is suitable for use by persons having limited range of motion in the wrist or weakness in the hand or fingers is also wanted. Furthermore, there is a need for a clothes hanger carrier that can be attached to an automobile interior hook or to a clothes rod. It would also be desirable for such a carrier to lend itself to the display of advertising or other indicia.

SUMMARY OF THE INVENTION

Accordingly, the principal object of the invention is to provide a clothes hanger carrier that adds comfort, simplicity, ease and speed to the motions involved in the loading and unloading of clothing supported by wire hangers. An object of this invention is to provide a compact carrier that shields the user's hand from the wire tips of the hanger hooks and has a comfortable handle. The invention is also intended to provide a carrier that is reusable and of sturdy construction in streamlined shapes which facilitate use.

Another object of the present invention is to afford a carrier that maintains the loaded hangers in a compactly bundled unit, preventing shifting or dislodging of the hooks from the carrier when the loaded garments are laid horizontal. In particular, the devices of the present invention allow positioning of the hangers parallel to the user's body.

Still another object of this invention is to provide a carrier suitable for use in the home, while traveling or in business, such as when (1) transporting clothing on hangers from the dry cleaners or laundromat, (2) supporting a laundry bag for the accumulation of clothing for delivery to the laundromat, (3) transporting hanging clothes by automobile, (4) moving or arranging hanging clothing in the home from the laundry room to closets or during closet reorganization, (5) transporting or delivering hanging garments by a dry cleaner, (5) moving inventory in a clothing store. It is a further object of the present invention to provide a comfortable carrier that is easy to use by those with physical limitations. The device is constructed in a manner in which it can be used as an incentive or promotional item, bearing a store's advertisement, as when given to customers with their hanging clothing purchases.

A clothes hanger transporting device for hand carrying one or a plurality of hangers is disclosed. The carrier includes a cantilevered handle, a textured or ribbed post attached to one end of the handle, and a shield attached to the other end of the post. The shield is substantially closed about the hanger hooks and protects the user's hands and palms from the wire tips of the hangers which rest on a semi-circular support bar in the shielded hanger port. The side panels of the shielded area may include a bordered inset area suitable for use as a display area for advertising and the like. For easier gripping and improved comfort, the handle may be contoured. The handle may also include on its underside, at a point about midway along the handle, a notch for suspending and centering the carrier on a closet rod, or the like. The centering notch also serves to stabilize the load of hangers while garments are being loaded or unloaded. Also included on the underside of the handle is a thumb hook hole for receiving a clothes hook mounted in the interior of an automobile, or elsewhere. The space between the handle and the top of the shield is sufficient to keep the user's knuckles from touching the shield when his hand is closed about the handle.

The carrier is generally in the shape of a truncated pyramid, with the handle being longer than the shield. The front of the shield is in the shape of an inverted "U", the open part of the "U" forming part of the mouth or front opening of the hanger port, through which the hangers to be carried are introduced tips first, either singly or in groups. In one embodiment of the invention the top, opposing side panels and back of the shield are closed. The bottom of the shield includes a support bar base and the front and rear openings of the hanger port, through which the hanger tips enter and exit, respectively. The configuration of the hanger port is such that the hanger hooks are compressed together or bundled to deter unintentional disengagement of the hooks.

The hanger hooks rest on a semi-circular support bar that extends across the hanger port from side wall to side wall, perpendicular the handle, thereby aligning the plane of the hanger bodies parallel to the handle. The support bar is one continuous piece that is attached to one of the side walls and rests the other, unattached, end against the opposite side wall on a semicircular support rest. The support bar is also supported by the support bar base running underneath it from side wall to side wall.

The carrier may be made of synthetic polymer by injection molding as two complementary halves which are matingly joined, but may be made of any suitable material or conventional method which produces a carrier as described having sufficient rigidity and durability for the intended purposes.

DESCRIPTION OF THE PREFERRED EMBODIMENT

Figure 1:
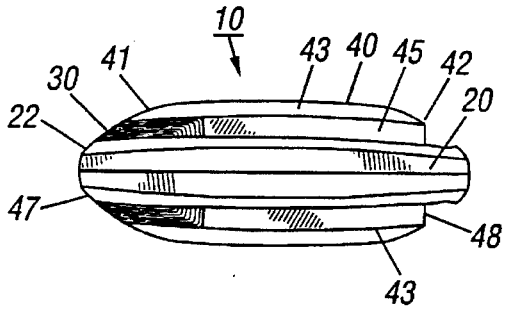
FIG. 1 is a top elevational view of the carrier of the present invention.
Figure 4:
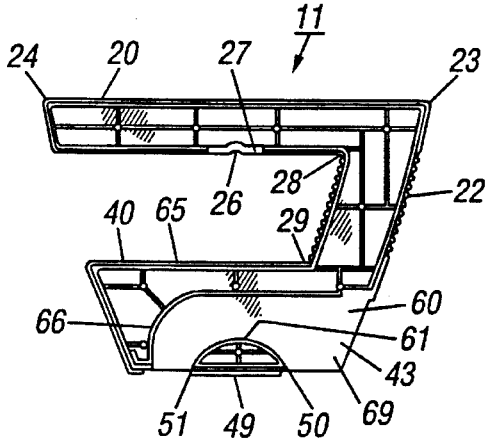
FIG. 4 is a left side cross-sectional view of the carrier.
Figure 5:
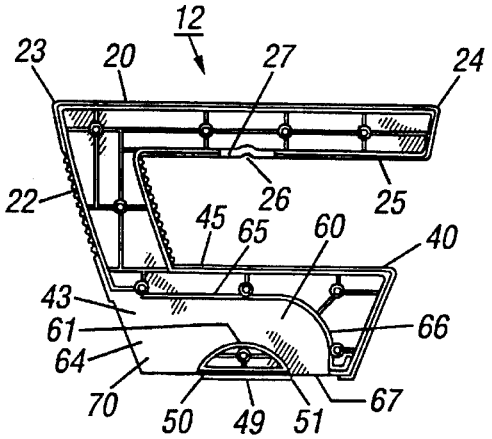
FIG. 5 is a right side cross-sectional view of the carrier.
Figure 15A:
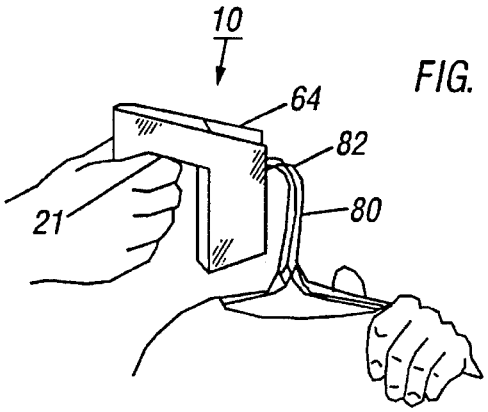
FIG. 15 illustrates how the carrier is used. A. Shows hanger hooks being inserted into the hanger port; B. Shows the turning motion placing the hooks over the bar; C. Shows the hook tips exiting the hanger port; C. Shows the device in the usual carrying position; D. Shows the over-the-shoulder carrying position; and E. Shows the carrier supported by a clothes rod.
Figure 15C:
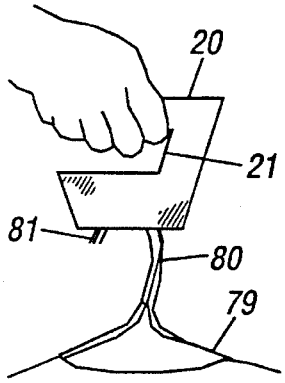
Figure 15B:
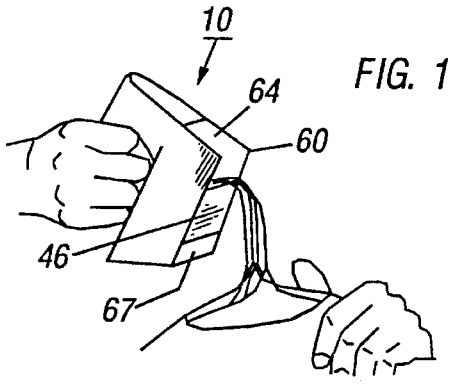

Reference is first made to FIGS. 15A–E which illustrate how carrier 10 is used. A user grasps handle 20 of carrier 10 about grip 21 and rotates carrier 10 to the loading position (FIG. 15A) so that front opening 64 of hanger port 60 faces upward. In addition to the handle grip 21, the carrier is supported during loading by resting post 22 against the user's finger. One or more clothes hanger hooks, separately or grouped, are inserted tips first into hanger port 60 and over arcuate support bar 61 (best shown in FIGS. 4 and 5). While inserting hooks 80, the user turns carrier 10 over hanger tips 81 toward the hook's arcuate portions 82 (FIG. 15B). Within hanger port 60 hook ends 81 are guided by upper wall 65, support bar 61 and back wall 66 (best shown in FIGS. 4 and 5) as hooks 80 are positioned over arcuate support bar 61. Hook tips 81 exit through rear opening 67 as arcuate portions 82 of hooks 80 contact support bar 61. As shown in FIG. 15C, carrier 10 is then returned to a substantially horizontal position for carrying (FIG. 15C). It can readily be seen that when carrying wire hangers 79, the user's hand is shielded from hooks 80 and wire tips 81. When the device is loaded with garments on hangers, the weight of the attached hangers and clothing is directed away from the palm of the hand. It can also be seen that the force exerted by hooks 80 of loaded clothes hangers 79 serves to hold the hooks in place allowing appreciable rocking or pivoting of hangers during movement without dislodging hooks 80. Additionally, as best shown in FIGS. 1, 4 and 5, side panels 43 are slightly outwardly arced from front 47 to back 48 of shield 40 to provide narrowing of hanger port 60 about the front opening 64 and rear opening 67. Side panels 43 are also slightly outwardly arced from top 45 to bottom 46 of shield 40 which also serves to narrow the mouth or front opening 64 and the rear opening 67. This narrowing of the front 64 and rear 67 of the hanger port has the effect of compressing or bundling the hanger hooks at those points while allowing the hooks to spread out somewhat over arcuate support bar 61. This bundling effect helps to prevent dislodgment of the hangers when the garments are laid horizontal or in the event that the hangers are jostled during transport. Removal of the hangers from the carrier, either singly or as a group, is accomplished by reversal of the loading operation.

Referring still to FIG. 15C, clothes hangers 79 are carried substantially parallel to the user's body with the load substantially centered beneath the user's hand. If desired, as an alternative way of carrying, the user can swing the loaded carrier over his shoulder, as shown in FIG. 15D (user illustrated in phantom lines).

Figure 2:
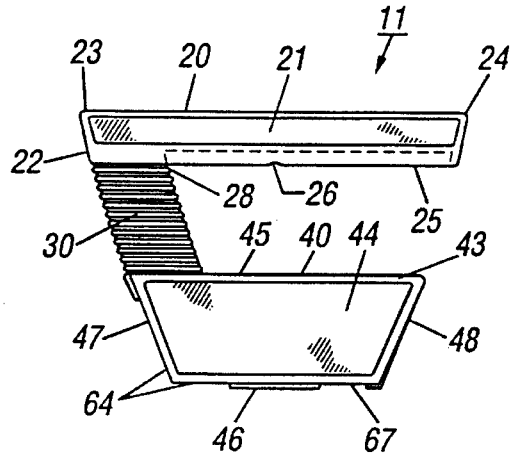
FIG. 2 is a left side elevational view of the carrier.
Figure 3:
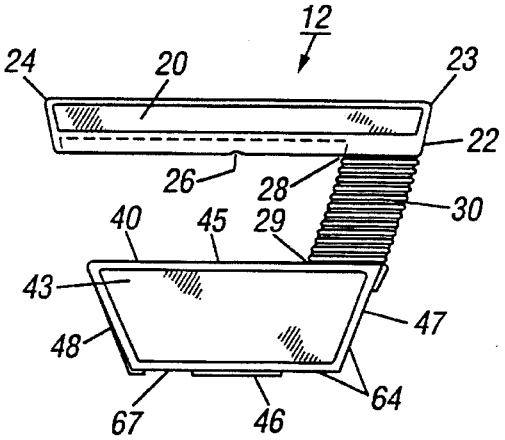
FIG. 3 is a right side elevational view of the carrier.
Figure 6:
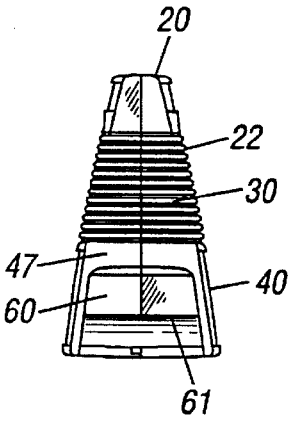
FIG. 6 is a front elevational view of the carrier.
Figure 7:
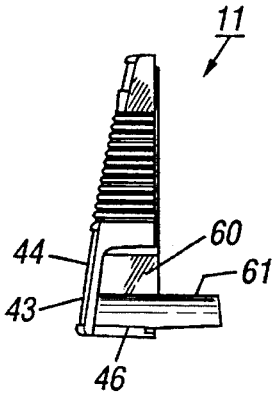
FIG. 7 is a right side front elevational view of the carrier.
Figure 8:
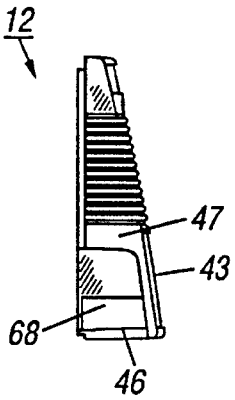
FIG. 8 is a left side front elevational view of the carrier.
Figure 9:
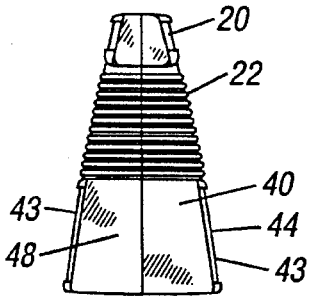
FIG. 9 is a back elevational view of the carrier.
Figure 10:
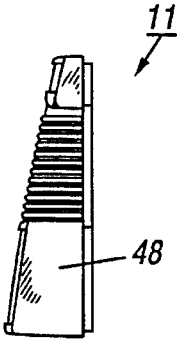
FIG. 10 is a left side back elevational view of the carrier.
Figure 11:
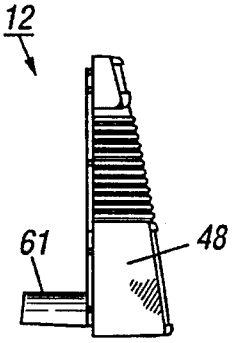
FIG. 11 is a right side back elevational view of the carrier.

A clothes hanger carrier embodying various features of the present invention is referred to generally as reference numeral 10. As shown in FIGS. 1–5, the carrier comprises cantilevered handle 20, post 22 and shield 40, which houses hanger port 60. Carrier 10 is preferably manufactured as two halves 11 and 12 (FIGS. 4 and 5) which are joined together to form a unitary structure. As shown in FIGS. 2 and 3, the length of carrier 10 is tapered from top to bottom such that shield 40 is shorter than handle 20. As shown in FIGS. 1 and 6, the width of carrier 10 is tapered such that handle 20 is narrower than shield 40. The physical structure of the carrier of the present invention will be further described below.

Figure 15E:
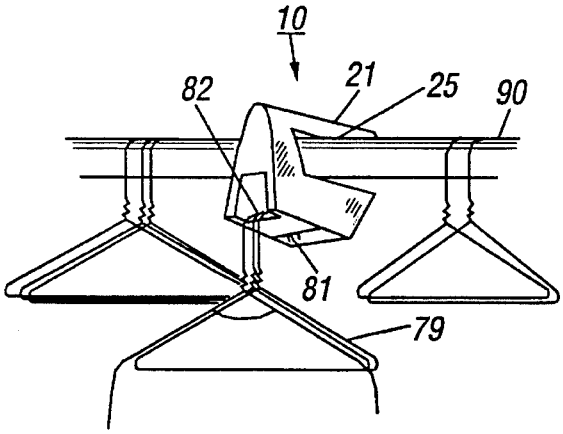
Figure 15D:
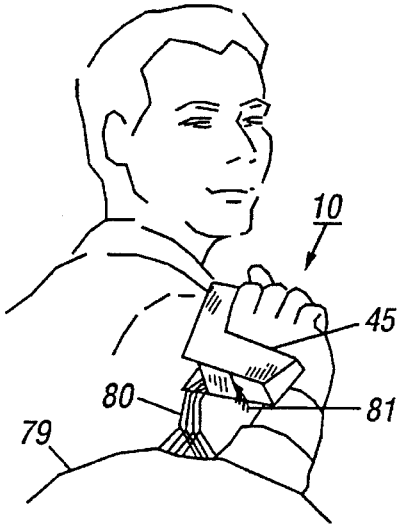

Handle 20 includes on its underside a small notch 26 (best shown in FIGS. 2–5) across its width that allows the carrier to be supported in a centered position on a clothes rod when the rod is inserted between handle 20 and shield top 45, depicted in FIG. 15E. It will be readily appreciated that when carrier 10 is supported by a clothes rod 90 (shown in phantom lines), one or more additional clothes hanger hooks may be added by inserting them tips 81 first and rotating hanger hook 80 over support bar 61. The location of notch 26 intermediate first end 23 and second end 24 of handle 20 serves to keep the hanger load centered and stable when suspended on a closet rod for unloading the hangered garments into closets.

Additional gripping ability is provided by textured or ribbed surface 30 (shown in FIGS. 1–3) of post 22 of carrier 10. When post 22 is positioned snugly against a supporting clothes rod, the carrier gains additional stability for loading or unloading clothing. The textured surface 30 of post 22 also aids the user in grasping and manipulating carrier 10 when, for example, loading garments into a car or maneuvering the carrier onto an automobile's interior thumb hook or interior car passenger handle, or when pushing the carrier over a clothes rod, as shown in FIG. 15E.

As shown in FIGS. 4 and 5, on the underside 25 of handle 20 is thumb hook receiver 27 for attaching carrier 10 to an interior automobile clothing hook or to a conventional household hook (not shown). Receiver 27 is located intermediate handle ends 23,24, is coincidental with notch 26 which is perpendicular thereto, and also serves to keep the loaded items centered and stable.

Reference is now made to FIGS. 1–14 showing additional features of carrier 10. Handle 20 may be contoured (best shown in FIG. 1) to provide for comfort and improved gripping during handling or carrying. Such contouring may consist of beveling or rounding of the handle surfaces. Handle 20 has a first end 23 that is joined to and integral with first end 28 of post 22. Surface 30 of post 22 may be ribbed or textured to provide additional gripping, as previously described. These and other features of carrier 10 make it easier to use by persons with diminished strength in their fingers or with weakened ability to grip, particularly since carrier 10 may additionally be gripped with a second hand about post 22.

On underside 25 of handle 20 is notch 26 and thumb hook receiver 27 for attachment to alternative support means such as an automobile clothing hook or closet clothes rod. In addition, a circular strap (not shown) may be attached to carrier 10 to provide another alternative means of supporting carrier 10.

Shield 40 has a first end 41 that is joined to and integral with second end 29 of post 22. The length of post 22 is sufficient to permit the user to grip handle 20 without his knuckles touching top 45 of shield 40. Best shown in FIGS. 4–6 and 10, shield 40 houses hanger port 60 and serves to protect the user's palm and fingers from clothes hanger tips 81, when carrier 10 is carried. Shield 40 also deters accidental snagging or disengagement of the clothes hanger hooks. Shield 40 includes side panels 43 each having a depressed area 44 suitable for placement of printed indicia or the like. Side panels 43 are preferably of a trapezoidal shape but may be shaped otherwise as long as side panels 43 provide the desired bundling effect of hanger hooks 80 within hanger port 60. As shown in FIGS. 2 and 3, side panels 43 also have a display area 44 which may be slightly depressed for placement of printed indicia or for label attachment. Shield 40 further includes a top 45, a bottom 46, a substantially open "U" shaped front 47 (best seen in FIG. 6) and a closed back 48 (best shown in FIG. 9).

Figure 12:
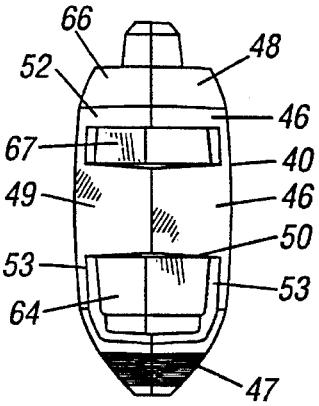
FIG. 12 is a bottom elevational view of the carrier.
Figure 13:
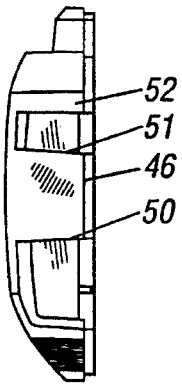
FIG. 13 is a left side bottom elevational view of the carrier.
Figure 14:
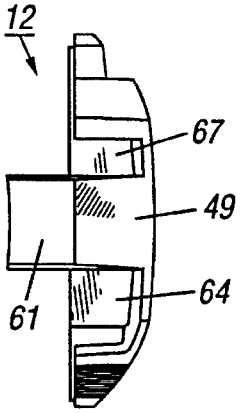
FIG. 14 is a right side bottom elevational view of the carrier.

Referring to FIGS. 6 and 12, front opening 64 of hanger port 60 is defined by "U" shaped front 47, side panels 43, upper wall 65, front edge 50 of support bar base 49, and front opening frame members 53. Rear opening 67 of hanger port 60 is defined by back wall 66, back edge 51 of support bar base 49, and rear opening frame 52, as shown in FIG. 12.

Referring now to FIGS. 7, 8, 11 and 14, hanger port 60 also includes arcuate support bar 61 upon which the clothes hanger hooks 80 hang. One end of support bar 61 is attached to the interior of side panel 43 on the right half 12 of carrier 10. Support bar 61 extends across hanger port 60 and overlaps arcuate support rest 68 which is attached to and integral with the opposite side panel 43 on the left half 11 of carrier 10 (shown in FIGS. 6–8 and 14). The seamless construction of arcuate support bar 61 where it spans hanger port 60 permits hanger hooks 80 to glide freely along support bar 61 during transport, thereby helping to maintain centering and stability of the load.

In one embodiment of the present invention carrier 10 is about 3.8" (1.50 cm) high, about 5" (1.97 cm) long at the top of handle 20 tapering to about 2.7" (1.06 cm) at the bottom. Carrier 10 tapers in width from about 0.7" (2.8 mm) at the top of handle 20 to about 2" (7.9 mm) at bottom 46. Shield 40 is about 1.5" high and the space between underside 25 of handle 20 and the top 45 of shield 40 is about 1.4" (5.5 mm). The radius of curvature of arcuate support bar 61 is approximately 0.648" (0.26 mm) and the length of the support bar base 40 is about 1.2" (4.72 mm). The maximum clothes hanger capacity of one embodiment of the invention is about 15. Carrier 10 is preferably of a size that can be slipped through the top opening of a conventional garment bag for easy loading and carrying of clothing on hangers. If desired, carrier 10 may be made proportionately smaller or larger, for commercial use, for example.

Carrier 10 is preferably made of acrylonitrile butadiene styrene (ABS) but any synthetic polymer or other material may be used which will provide a carrier of sufficient strength and durability. For instance, where the device is to be used in an industrial setting and subjected to heavy usage, molded metal such as aluminum or aluminum alloys may be used. Carrier 10 is preferably constructed by swage fitting of two opposing halves, as shown in FIGS. 4 and 5, to form a carrier of unitary structure; however other suitable methods, such as screws or snaps, may be used to mate the two halves or to produce the unitary structure of the carrier of the present invention.

While the preferred embodiment of the invention has been shown and described, modifications thereof can be made by one skilled in the art without departing from the spirit and teachings of the invention. The embodiment described herein is exemplary only, and is not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. A clothes hanger carrier comprising:

a cantilevered handle;

a post having one end joined to and integral with one end of said handle;

a shield joined to and integral with the other end of said post, said shield comprising two elongate opposing side panels disposed parallel said handle;

a hanger port disposed within said shield, said port comprising a front opening and an arcuate support bar adapted for supporting the hooks of one or more clothes hangers to be carried.

2. The carrier of claim 1 wherein said handle further comprises a contoured grip.

3. The carrier of claim 1 wherein said handle has an underside comprising a centering notch and a thumb hook receiver.

4. The carrier of claim 1 wherein said handle is longer than said shield.

5. The carrier of claim 1 wherein said shield is adapted to protect a user's hand from contact with the clothes hanger hooks supported in said hanger port.

6. The carrier of claim 1 wherein said post comprises a grip-enhanced surface.

7. The carrier of claim 1 wherein said hanger port is adapted to provide a bundling effect on the hooks sufficient to deter dislodgment of the hooks.

8. The carrier of claim 1 wherein said carrier is made of a synthetic polymer.

9. The carrier of claim 1 wherein said arcuate support bar is a continuous structure spanning said hanger port perpendicular said handle.

10. A clothes hanger carrier comprising:

a cantilevered handle;

a post having one end joined to and integral with one end of said handle:

a shield joined to and integral with the other end of said post, said shield comprising a top, a bottom, opposing side panels, a substantially open front, and a closed back;

a hanger port disposed within said shield, said port comprising an arcuate support bar adapted for supporting the hooks of one or more clothes hangers to be carried.

11. The carrier of claim 10 wherein said opposing side panels are parallel said handle.

12. The carrier of claim 10 wherein said top is spaced away from said handle about 1.4 inches (5.5 mm).

13. The carrier of claim 10 wherein at least one said shield side panel comprises a display area.

14. The carrier of claim 13 wherein said display area is recessed.

15. The carrier of claim 14 wherein said hanger port further comprises an arcuate support rest attached to and integral with one of said side panels and one end of said arcuate support bar is attached to and integral with the other side panel, the other end of said support bar being disposed upon said arcuate support rest and said support bar also being disposed on said shield bottom.

16. The carrier of claim 15 wherein said hanger port further comprises a front opening, an upper wall, a back wall and a rear opening.

17. The carrier of claim 16 wherein said hanger port front opening is large enough to permit loading of more than one hanger hook at a time.

18. The carrier of claim 17 wherein said carrier is adapted for being manufactured by injection molding as two complementary halves capable of being matingly joined.

19. A clothes hanger carrier for transporting at least one garment loaded on a hanger, said carrier comprising:

a cantilevered handle having a contoured grip, and a centering notch and thumb hook receiver disposed on the underside of said handle midway along the length of said handle underside;

a grip-enhanced post having one end joined to and integral with one end of said handle;

a six-sided shield joined to and integral with the other end of said post, the first side being a closed top, the second and third sides being opposed arcuate side walls running parallel said handle, each said side wall having at least one recessed display area, the fourth side being a closed back, the fifth side being a substantially open front, and the sixth side being a bottom having front and rear openings;

a hanger port disposed within said shield, said port comprising a continuous semi-circular support bar adapted for engaging one or more clothes hanger hooks, the first end of said bar being integral with one of said side walls, an arcuate support rest that is integral with the other side wall, said support bar having its second end disposed upon said support rest and a curved upper wail adapted to guide the hooks around the support bar during insertion, said hanger port adapted for providing a bundling effect on the hooks sufficient to deter unintentional dislodgment.

20. A device for hand carrying one or more clothes hangers with garments thereon, said device having a unitary structure, wherein the improvement comprises:

a cantilevered contoured handle;

a grip-enhanced post having one end joined to and integral with one end of said handle and;

a shield joined to and integral with the other end of said post, said shield adapted for substantially covering the hooks when the device is being used for carrying clothes hangers whereby the hooks are supported on a continuous arcuate hook support bar disposed within said shield, said .support bar running perpendicular said handle, said shield adapted for bundling the hooks sufficient to deter unintentional dislodgment and said device adapted for protecting the user's hands from the hooks during transport of the hangers.

* * * * *